US005217271A

United States Patent [19]

Moe

[11] Patent Number: 5,217,271

[45] Date of Patent: Jun. 8, 1993

[54] PORTABLE BAG HOLDER

[76] Inventor: Calvin A. Moe, HC 05, Box 234, Park Rapids, Minn. 56470

[21] Appl. No.: 769,441

[22] Filed: Oct. 1, 1991

[51] Int. Cl.[5] ..... B65B 67/00

[52] U.S. Cl. ..... 294/1.1; 248/99

[58] Field of Search ..... 294/1.1, 143, 159, 55, 294/61; 248/95, 99, 100, 101

[56] References Cited

U.S. PATENT DOCUMENTS

| | | | |
|---|---|---|---|
| D. 271,718 | 12/1983 | Johno, Jr. et al. | D34/24 |
| D. 278,128 | 3/1985 | VanDine et al. | D9/455 |
| 936,975 | 10/1909 | Abel | 119/68 |
| 1,005,235 | 10/1911 | Langguth | 294/87.2 |
| 1,012,045 | 12/1911 | Adams | 119/68 |
| 1,460,554 | 7/1923 | Moore | 294/159 |
| 2,637,475 | 5/1953 | Gialanella | 224/45 |
| 3,339,814 | 9/1967 | Carbine | 224/45 |
| 3,679,160 | 7/1972 | Ballenger | 248/9 |
| 3,754,785 | 8/1973 | Anderson | 294/19 R |
| 4,596,413 | 6/1986 | LaPorte | 294/61 X |
| 4,738,478 | 4/1988 | Bean, Jr. | 294/1.1 X |
| 4,750,695 | 6/1988 | Greenhouse | 248/99 |
| 4,805,858 | 2/1989 | Taylor | 248/99 |
| 5,000,406 | 3/1991 | Peterson | 294/1.1 X |
| 5,033,703 | 7/1991 | Allen, Sr. | 248/95 X |

FOREIGN PATENT DOCUMENTS

| | | | |
|---|---|---|---|
| 554881 | 7/1943 | United Kingdom | 248/95 |
| 2214880 | 9/1989 | United Kingdom | 248/95 |

*Primary Examiner*—Joseph D. Pape

*Attorney, Agent, or Firm*—Zarley, McKee, Thomte, Voorhees & Sease

[57] ABSTRACT

A portable bag holder comprising a substantially flat support having first and second bag holders at the opposite ends thereof. The bag holder may be used to support a single garbage bag thereon or may be used to support a pair of garbage bags thereon when the trash is to be segregated into recyclable and non-recyclable items. A pair of bungee cords are attached to the holder to maintain the bag or bags thereon.

2 Claims, 3 Drawing Sheets

PORTABLE BAG HOLDER

BACKGROUND OF THE INVENTION

It has become popular in recent years for groups of people to "adopt-a-road" and to periodically collect the trash which has accumulated in the ditches of the particular road. Heretofore, a person would walk along the ditch of the road and would carry a plastic garbage bag in one hand and place the trash or litter in the bag with his or her other hand. Such a task is made even more difficult by the fact that the bag does not remain open and is difficult to handle in the wind. Further, when the garbage bag is placed on the ground, the litter tends to spill therefrom. Yet another disadvantage of the conventional method of collecting trash is that there is no means to segregate recyclable items from the non-recyclable items.

It is therefore a principal object of the invention to provide an improved bag holder which may be used for the collection of trash, pine cones, fruit, household waste, etc.

Still another object of the invention is to provide an improved bag holder which permits the installation of a single garbage bag thereon or which permits the installation of two or more garbage bags thereon to permit the segregation of trash from recyclable items.

Still another object of the invention is to provide a portable bag holder which accommodates persons of different heights Still another object of the invention is provide a portable bag holder which maintains the ends of the bag or bags in an open position to facilitate the placement of trash or other materials therein.

Yet another object of the invention is provide a bag holder which prevents trash from blowing or flowing from the bag when the bag is in use or placed on the ground.

Yet another object of the invention is to provide a safe and easy means for removing items impaled on a nail stick.

Still another object of the invention is to provide a portable bag holder which maintains the bag or bags in an open position so as to speed the collection process.

Still another object of the invention is to provide a portable bag holder which is economical of manufacture, durable in use and refined in appearance.

These and other objects of the present invention will be apparent to those skilled in the art.

SUMMARY OF THE INVENTION

Figure 1:
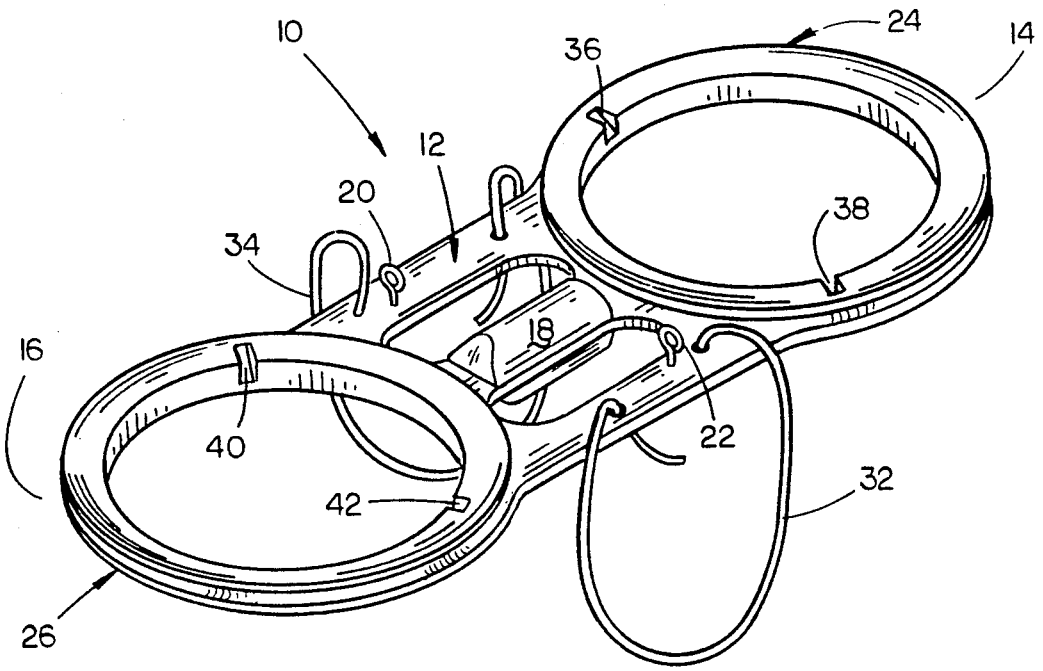
FIG. 1 is a prospective view of the bag holder of this invention.

A portable bag holder is described which includes a substantially flat support having first and second bag holders mounted thereon with a handle positioned therebetween. A single garbage bag may be mounted on the bag holder so that the garbage bag extends around both of the first and second bag holders.

When it is desired to segregate the materials being collected, a first garbage bag may be positioned on the first bag holder and a second garbage bag mounted on the second bag holder so that recyclable items may be placed in the first bag and so that trash items may be placed in the second bag.

DESCRIPTION OF THE PREFERRED EMBODIMENT

The bag holder of this invention is referred to generally by the reference numeral 10 and includes a central portion 12, and opposites ends 14 and 16. Handle 18 is provided in the central portion 12 to enable the bag holder 10 to be conveniently carried in a substantially horizontal position. A pair of eye screws 20 and 22 are provided to permit the attachment of shoulder straps or the like thereto so that the bag holder may be supported from the collector's shoulder rather than being hand carried.

The numeral 24 refers to a first bag holder provided at end 14 while the numeral 26 refers to a second bag holder which is provided at end 16. Bag holders 24 and 26 are ring-shaped and are provided with peripheral grooves 28 and 30 formed in the outer periphery thereof respectively. Although the device is illustrated as being adapted to hold one or two bags, the bag holder could be designed to accommodate three or more bags, if desired.

The opposite ends of a bungee cord 32 are secured to central portion 12 and are designed to be extended around the bag holder 24 and received in the peripheral grooves 28 to maintain a plastic garbage bag or the like thereon as will be described in more detail hereinafter. Although a bungee cord is the preferred means to secure a bag onto the holder, the cord 32 could be replaced with a rope, wire spring, etc. Similarly, the opposite ends of bungee cord 34 are secured to central portion 12 of the bag holder and are adapted to extend around the second bag holder 26 and to be received within the peripheral grooves 30 to maintain a plastic garbage bag or the like thereon.

The inner periphery of bag holder 24 is provided with a pair of notches 36 and 38 while the inner periphery of bag holder 26 is provided with a pair of notches 40 and 42 for a 1 purpose to be described in more detail hereinafter.

Figure 2:
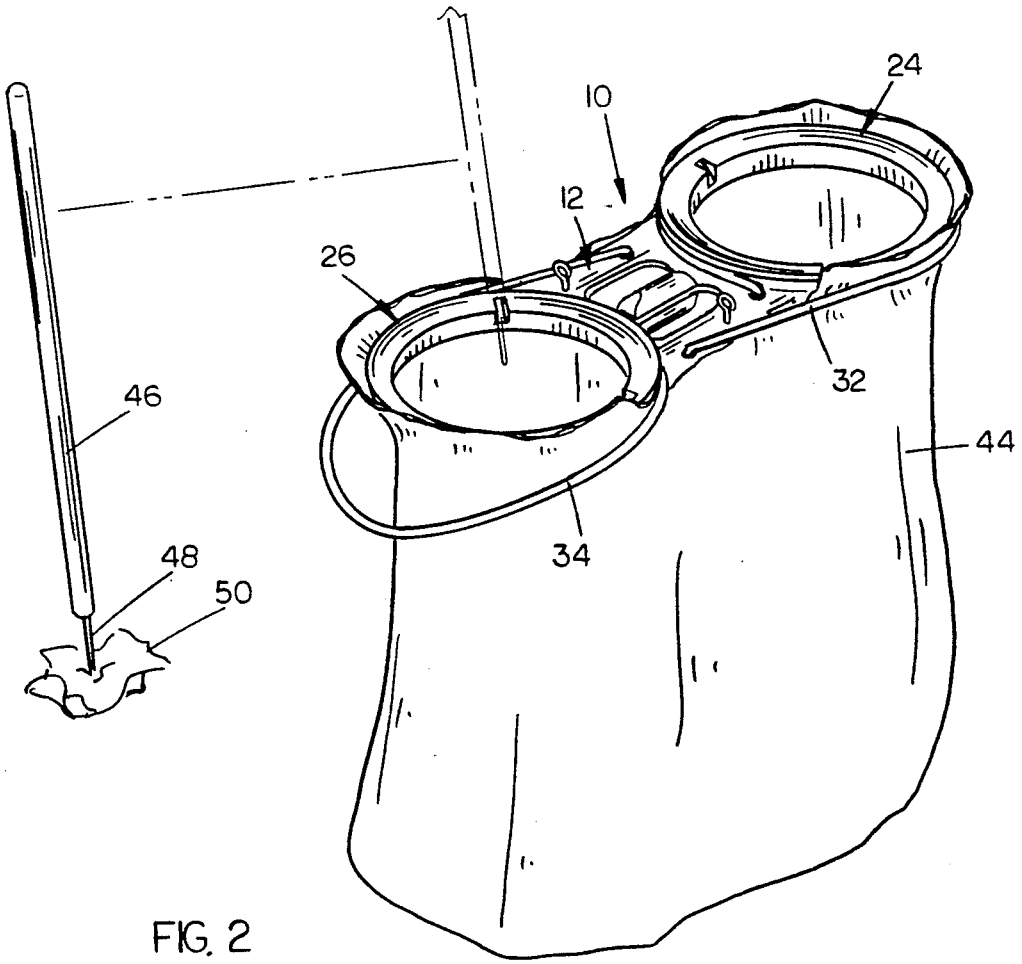
FIG. 2 is a prospective view of the bag holder of this invention having a single garbage bag mounted thereon.
Figure 3:
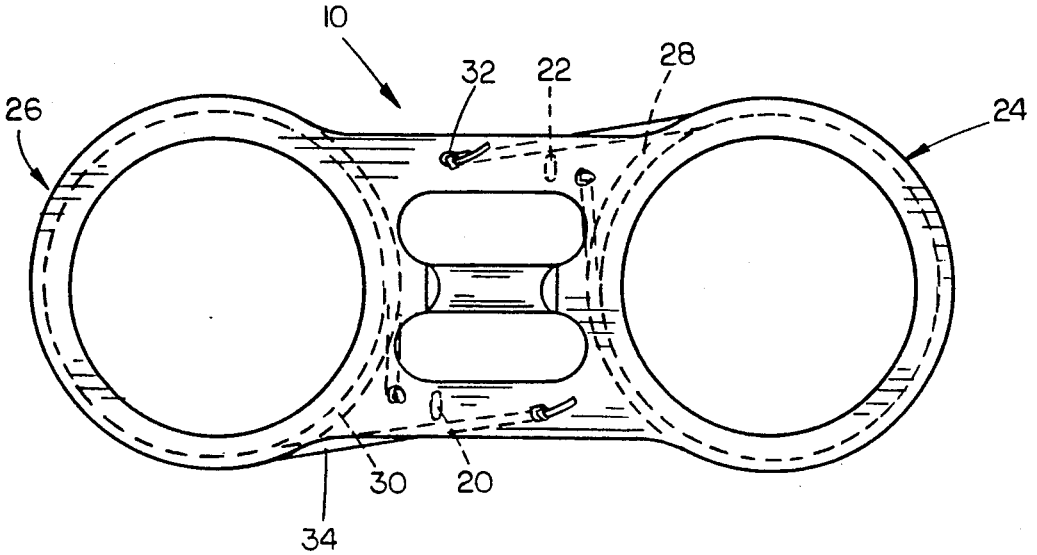
FIG. 3 is a bottom view of the bag holder of this invention.
Figure 4:
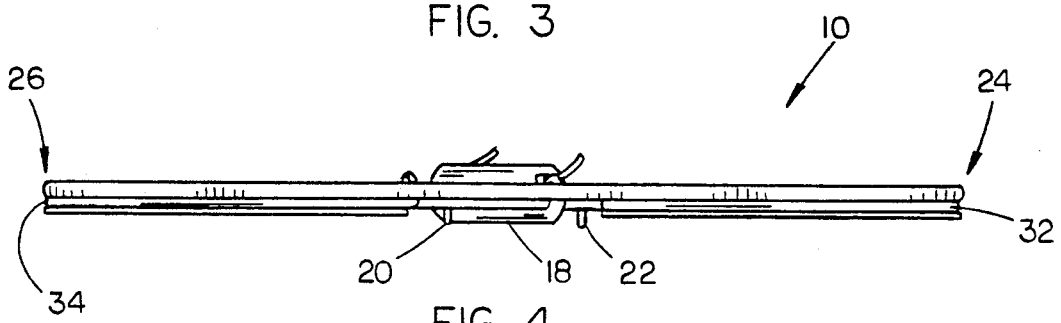
FIG. 4 is a side view of the holder in an inverted position.
Figure 5:
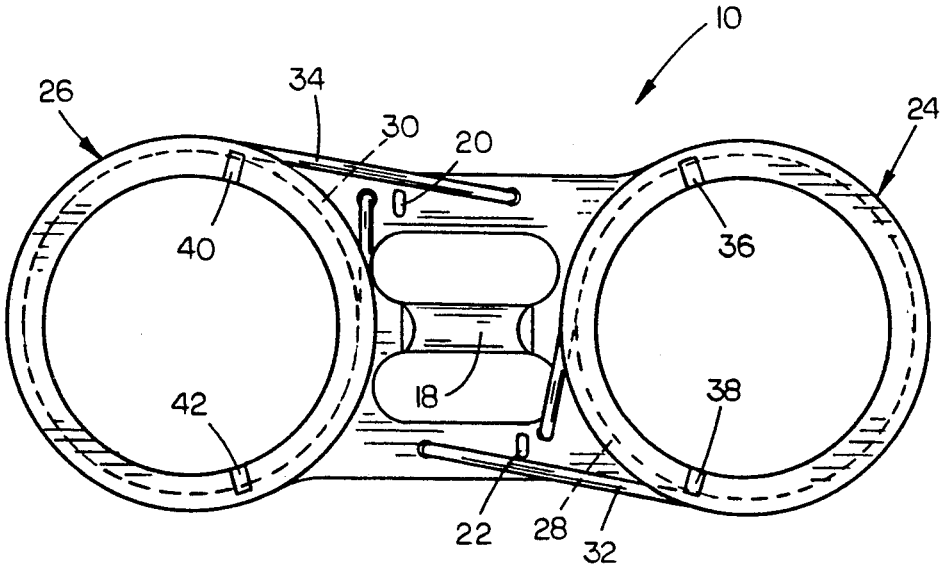
FIG. 5 is a top elevational view of the bag holder.
Figure 6:
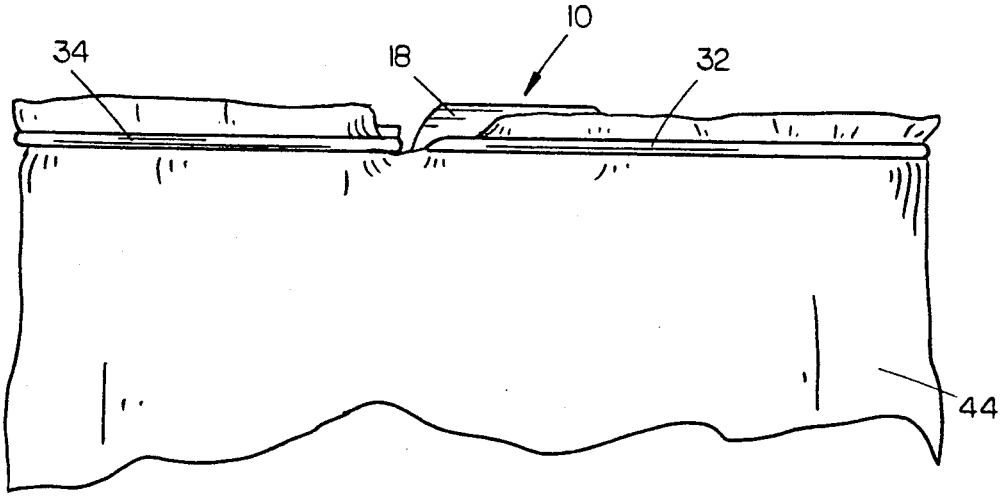
FIG. 6 is a side view illustrating a single bag mounted on the bag holder.

When it is desired to support a single garbage bag 44 on the holder 10, the bungee cords 32 and 34 are loosened with the open upper end of the bag 44 being positioned around the bag holders 24 and 26 in the manner illustrated in FIG. 2. The bungee cords 32 and 34 are then extended around the outer peripheries of the grooves 28 and 30 respectively and received thereby to maintain the garbage bag 44 on the holder. The trash collector may then grasp the handle 18 and carry the holder 10 and garbage bag 44. If the person collecting the trash is unusually short, the bag 44 may be positioned on the holder 10 in such a fashion so that a greater portion of the upper end of the bag is positioned above the bag holder with the bag then having an overall effective shorter length. The trash may be placed into the interiors of either of the bag holders 24 or 26 for reception by the bag 44. If a nail stick 46 is being utilized, the nail 48 may be received in any of the notches 36, 38, 40 and 42 to facilitate the removal of the trash 50 therefrom in the manner illustrated by broken lines in FIG. 2.

Figure 7:
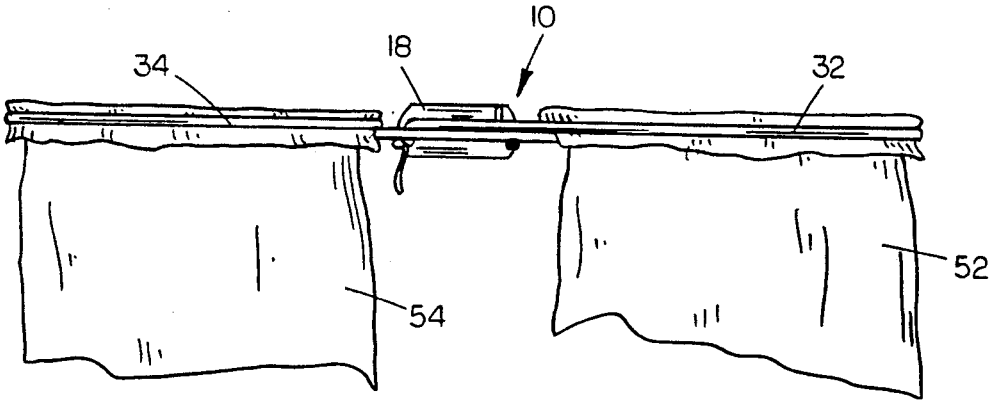
FIG. 7 is a side view illustrating a pair of bags mounted on the holder.
Figure 8:
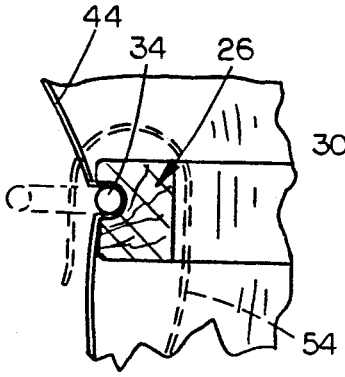
FIG. 8 is a sectional view illustrating a bag mounted on the bag holder with the broken lines illustrating the means for attaching a bag to the holder when a pair of bags are being utilized.
Figure 9:
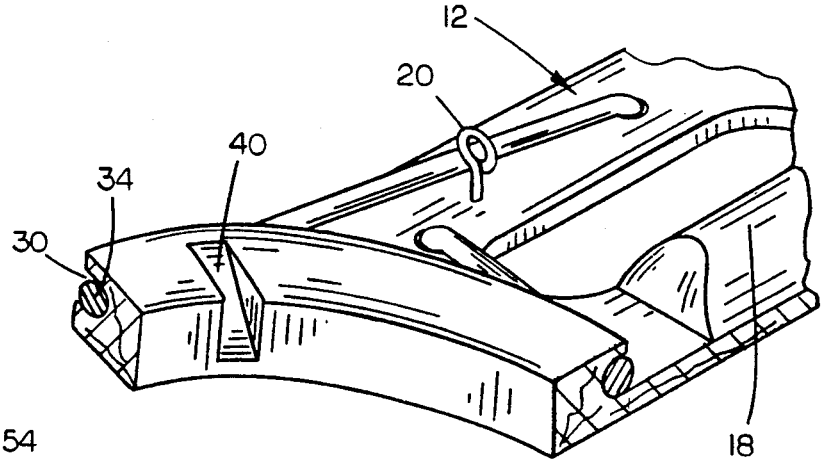
FIG. 9 is a partial sectional view of the bag holder.

When it is desired to segregate recyclable items from non-recyclable items, a pair of garbage sacks 52 and 54 are mounted on the holders 24 and 26 in the manner illustrated in FIG. 7. In such a situation, the upper ends of the garbage bags 52 and 54 are inserted upwardly through the interiors of the holders 24 and 26 respectively and then folded downwardly and outwardly of the holders so that the bungee cords may be installed to maintain the bags on the holder as illustrated in FIG. 7. When two or more bags are utilized, the bags may be adjusted in a manner similar to that described herein above to accommodate short persons. In FIG. 8, the solid lines illustrate the bungee cord 34 maintaining a single bag 44 on the holder 26. The broken lines in FIG. 8 illustrate the means by which the upper end of the bag 54 is positioned relative to the holder 26 when a pair of bags are being utilized.

It can be seen that the bag holder 10 maintains the upper end of a garbage bag or bags in an open condition so that trash may be conveniently placed in the bag or bags. The holder 10 makes it much easier to perform the trash collection operation and makes the bag or bags much easier to handle in windy situations. Further, when the bag or bags are lowered onto the ground, the holder tends to close the upper ends of the bag or bags to prevent trash from flowing or blowing therefrom.

Thus it can be seen that the invention accomplishes at least all of its stated objectives.

I claim:

1. A portable bag holder, comprising, a substantially flat support means designed to be carried in a generally horizontal position and having an upper end, a lower end, a central portion and opposite end portions, handle means provided on said central portion for grasping by the person utilizing the bag holder, a first rounded bag holder means provided on one of said end portions for supporting the upper end of a flexible bag thereon in an open condition;

a second rounded bag holder means provided on the other of said end portions for supporting the upper end of a flexible bag thereon in an open condition, a resilient member for selectively maintaining a bag on one of said first and said second bag holder means, each of said bag holder means comprising, a ring-shaped member having inner and outer peripheral surfaces, said outer peripheral surface including an annular groove formed therein for receiving said resilient member therein to maintain the upper end of an associated bag therein, said resilient member comprising, an elongated bungee cord having its opposite ends secured through said central portion with its opposite ends spaced apart such that said bungee cord surrounds less than the entire perimeter of a ring-shaped member.

2. A portable bag holder, comprising, a substantially flat support means designed to be carried in a generally horizontal position and having an upper end, a lower end, a central portion and opposite end portions, handle means provided on said central portion or grasping by the person utilizing the bag holder, a first rounded bag holder means provided on one of said end portions for supporting the upper end of a flexible bag thereon in an open condition, a second rounded bag holder means provided on the other of said end portions for supporting the upper end of a flexible bag thereon in an open condition, a pair of resilient members for selectively maintaining a bag on said first and said second bag holder means, and a single bag having an open upper end connected to said first and second bag holder means and supported thereon by said resilient member.

* * * * *